United States Patent [19]

Reinhardt

[11] Patent Number: 4,502,867

[45] Date of Patent: Mar. 5, 1985

[54] PAD-DYEING AND PRINTING SYNTHETIC FIBER MATERIALS USING DISPERSE DYE AND CARBOXYL SYNTHETIC POLYMER AND POLYSACCHARIDE THICKENER COMBINATION

[75] Inventor: Friedrich Reinhardt, Bad Soden am Taunus, Fed. Rep. of Germany

[73] Assignee: Hoechst Aktiengesellschaft, Frankfurt am Main, Fed. Rep. of Germany

[21] Appl. No.: 566,965

[22] Filed: Dec. 29, 1983

Related U.S. Application Data

[63] Continuation of Ser. No. 452,323, Dec. 22, 1982, abandoned.

[30] Foreign Application Priority Data

Dec. 24, 1981 [DE] Fed. Rep. of Germany ..... 3151451

[51] Int. Cl.[3] ..... D06P 1/48

[52] U.S. Cl. ..... 8/557; 8/558; 8/559; 8/561; 8/562; 8/921; 8/922; 8/924

[58] Field of Search ..... 8/558, 559, 561, 557, 8/562

[56] References Cited

U.S. PATENT DOCUMENTS

| | | | |
|---|---|---|---|
| 4,095,942 | 6/1978 | Dellian et al. | 8/558 |
| 4,181,498 | 1/1980 | Koltai et al. | 8/558 |
| 4,197,087 | 4/1980 | Ami et al. | 8/558 |
| 4,297,100 | 10/1981 | Koci et al. | 8/558 |

FOREIGN PATENT DOCUMENTS 1904309 10/1970 Fed. Rep. of Germany .

*Primary Examiner*—A. Lionel Clingman
*Attorney, Agent, or Firm*—Curtis, Morris & Safford

[57] ABSTRACT

The electrolyte sensitivity of carboxyl-containing synthetic thickeners causes problems on application together with disperse dyestuffs, the commercial finish (dispersants) of which is of anionic nature.

These known disadvantages can be eliminated by adding natural thickenings which are based on polysaccharides to the synthetically based products the properties of which are considered unsatisfactory, and setting a certain, acidic pH value in the thickening mixtures. Illustratively, proceeding in this manner it was found on pad-dyeing and printing, for example, polyester fibers with conventionally finished disperse dyestuffs that the use of the auxiliary combinations according to the invention not only stabilized the thickening but also brought about an increase in depth of shade. The systematic pH adjustment of the thickening mixtures results in considerable color yield gains.

9 Claims, No Drawings

PAD-DYEING AND PRINTING SYNTHETIC FIBER MATERIALS USING DISPERSE DYE AND CARBOXYL SYNTHETIC POLYMER AND POLYSACCHARIDE THICKENER COMBINATION

This application is a continuation of application Ser. No. 452,323, filed Dec. 22, 1982, now abandoned.

The prime function of thickeners in textile printing is to bring about conditions under which a dyestuff in the form of a paste can be transferred to a well-defined area of a fiber structure by mechanical or mechanized means. In pad-dyeing they perform a similar function in that they ensure that the dyestuff made up as a liquid formulation does not migrate during the drying process and that a novel dyeing is obtained on the sheet-like textile material.

In addition to this main function a thickening must in industry as a rule satisfy still further requirements. These include, inter alia, immunity to and weak restraining action on the dyestuff used, which manifests itself in a very high proportion of the dyestuff being donated to the fiber by the thickened print paste during the printing and fixing process—a state of affairs which first of all makes possible optimal utilization of the amount of dyestuff used and hence results in a high color yield.

The simultaneous desire to have well-delineated print contours usually requires the use of high-solids natural thickenings when printing synthetic fiber materials, because of the hydrophobic character of the parent fiber substances—a necessity which in turn hampers, especially in high-temperature fixing methods, the dyestuff's transfer from the thickening film into the synthetic fiber, so that auxiliaries in the form of carriers (as described, for example, in German Pat. No. 2,250,017) must be added to the print pastes used in these cases.

Incomplete dyestuff utilization caused for this reason and which is responsible for not only an unsatisfactory color yield but also problems concerning washing and even bleeding into the white ground has long provided grounds for complaint.

The development of synthetic thickeners as described, for example, in German Offenlegungsschrift No. 1,619,666, German Offenlegungsschrift No. 1,769,466, German Offenlegungsschrift No. 1,904,309 and Melliand Textilberichte 5/1972, pages 580–586, and the structure of which is based on copolymers of acrylic acid or maleic acid or of their derivatives and which were originally designed mainly for pigment printing in order to replace a high white spirit content enveloping emulsion thickenings used there, has in the meantime also become established in printing methods using disperse dyestuffs on polyester fiber materials, leading here to increased brilliance and color yield and to a reduction in the wash problems.

Yet the synthetic thickeners mentioned are themselves afflicted with a serious problem, namely their extreme electrolyte sensitivity. Since, however, most disperse dyestuffs have in general been finished with anionic dispersants, this deficient behavior of known thickenings required the development of new disperse dyestuff ranges, which consisted of nonionically finished dyestuffs; this fact led in many cases to dyeing and printing works keeping duplicate stock, a policy which is in principle undesirable.

It is then an object of the present invention to eliminate the electrolyte sensitivity of synthetic thickeners, which interferes with their application.

This object has been achieved according to the invention in that it was found that the problem described above in respect of the stability of known synthetic thickenings and hence the need for a separate range of nonionically finished disperse dyestuffs can be eliminated if pure synthetic thickenings are replaced by mixtures thereof and high viscosity polysaccharides and a certain pH value is set in the thickening mixtures.

The present invention thus relates to a process for pad-dyeing and printing sheet-like synthetic fiber textile material using disperse dyestuffs, wherein the padding liquors or print pastes, in addition to the aqueous dyestuff dispersion, also contain auxiliary combinations or carboxyl-containing synthetic thickenings and natural thickenings which are based on polysaccharides and 1% strength aqueous solutions of which have a viscosity of 0.05 to 20 Pas, preferably 2.0 to 4.0 Pas (measured by means of the VT 02 Haake Viscotester), and wherein the padding liquors or print pastes have a pH value of 1.2 to 4.5, preferably 2.0 to 3.5.

Accordingly the present invention also relates to an auxiliary for carrying out the process described above, which comprises a combination of carboxyl-containing synthetic thickenings and natural thickenings which are based on polysaccharides and 1% strength aqueous solutions of which have a viscosity of 0.05 to 20 Pas.

Within the scope of the invention it was possible to ascertain that the addition of polysaccharides not only stabilized the synthetic thickening but also that carrying out of the new process resulted at the same time in an increase in depth of shade. For instance, it was found that it was possible to increase color yields considerably, i.e. by 20–90%. In the process, the pH value is set by adding weak to medium inorganic or organic, monobasic or polybasic acids or corresponding acidic salts. While pure synthetic thickenings drastically reduce their viscosity on the addition of such electrolytes, and usually become water-thin, the abovementioned mixtures are stable to electrolytes for a prolonged period, i.e. for several weeks.

A further advantage of thickening mixtures described in the invention is that the sharpness of print, i.e. the definition of contours, is markedly better than in printing using pure synthetic thickenings.

The composition of the new thickening mixtures can vary between a proportion of 5% for the synthetic thickening and 95% by weight for the polysaccharide, and vice versa; it depends on the individual response of the products used to the disperse dyestuffs used. Mixtures which are preferable as regards the dispersion stability of the dyestuffs contain about 30 to 70% by weight each of the two components.

The increased color yield which results from practicing the process according to the invention may be thought of as being partially, but not exclusively, due to a reduction in penetration. It is observed not only in hot-air fixing and high-temperature steaming but also in saturated steam fixing on polyester fiber materials of differing origin and production method and on triacetate or polyamide 472 fiber structures.

Examples of suitable carboxyl-containing synthetic thickenings which can be used according to the invention are aqueous solutions or gel-forming dispersions of polymerized low molecular weight monoethylenically or polyethylenically unsaturated monocarboxylic or dicarboxylic acids, such as polyacrylic acid and its homologs, for example products of polymerizing methacrylic acid or crotonic acid, and of polymers of carboxyalkyl derivatives, such as itaconic or teraconic acid, similarly aqueous solutions or dispersions of polymerized maleic acid or of its anhydride and fumaric acid and of its homologs, such as, for example, citraconic acid or mesaconic acid, further of copolymers of olefins, for example ethylene, propylene or butadiene, or of lower alkyl acrylates, optionally substituted acrylamides, vinyl alcohols, vinyl ethers, vinyl esters, vinyl chloride, vinylidene chloride, styrene, acrylonitrile and analogous alkyl compounds and the above-mentioned monomers. These examples also include the reaction products of the polymers and copolymers described, with polyhydric alcohols and amines, or amino alcohols, and combinations of highly polymerized products with less highly polymerized products.

Polysaccharides used according to the invention embrace optionally degraded and/or etherified natural products such as high molecular weight carob bean flour or guar flour and starch or cellulose ethers.

In the examples which follow, the pH values of the print pastes were measured with a type 160 Knick pH meter, the viscosities with a VT 02 Haake Viscotester, and the color yields with a Bausch and Lomb reflectance spectrophotometer. The percentages are percentages by weight. The Color Index numbers were taken from the 2nd edition (1956) and the 1963 supplement.

Although the process claimed permits not only the use of nonionically finished disperse dyestuffs but also of anionically finished disperse dyestuffs, nonionically finished disperse dyestuffs were prodominantly used in the examples in order to demonstrate the gain in color yield over the process which uses pure synthetic thickenings and which can only be carried out with these dyestuffs.

The thickeners used in the examples which follow are all branded products (®=registered trademark). From a chemical viewpoint they are:

| | |
|---|---|
| Synthetic thickenings | |
| ® Acraconc C (Bayer) | based on polycarboxylic acids |
| ® Carbopol 846 (Goodrich) | strongly acidic acrylic polymers |
| EMA 91 (Monsanto) | ethylene/maleic anhydride copolymers |
| ® Imperon thickener F (Hoechst) | based on polyacrylic acid |
| ® Lutexal HSF (BASF) | based on acrylate |
| ® Samaron thickener N (Hoechst) | mixture based on polyacrylic acid and hydroxyethylcellulose. |
| Natural thickenings | |
| ® Diagum S2 (Diamalt) | based on galactomannans |
| ® Polyprint N 271 (Polygal) | locust bean flour derivative |
| ® Prisulon L 150 K (Chem. Fabr. Tübingen) | based on locust bean flour |
| ® Tylose C 600 (Kalle) | carboxymethylcellulose |
| ® Tylose MH 300 (Kalle) | methylcellulose |
| ® Tylose H 4000 (Kalle) | hydroxyethylcellulose |
| ® Monagum W (Diamalt) | starch ether. |

EXAMPLE 1

(a) A twill made of continuous polyethylene glycol terepthalate filaments is printed with a print paste of the following composition:

30 g of a commercially available liquid formulation of the disperse dyestuff of the formula:

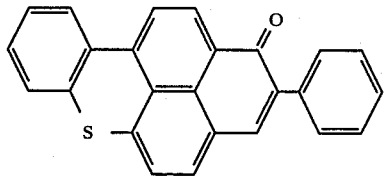

are stirred into:

970 g of an aqueous print paste which contains:

28 g of Samaron thickener N and:

12 g of a condensation product of stearic acid and polyglycol 1,000.

The pH value of the prepared print paste is 6.3, and its viscosity is 70 d Pas. The printed fabric is dried and then steamed at 175° C. for 7 minutes in a high-temperature steamer to fix the dyestuff, thereafter rinsed with water, and finally washed at 90° C. for 10 minutes in an aqueous bath to which 1 g per liter of 20-fold oxyethylated nonylphenol has been added.

A brilliant yellowish red print having good fastness properties is obtained.

(b) The same fabric is printed with a print paste which contains the same dyestuff in the same concentration and also:

475 g of a 2% strength aqueous solution of Samaron thickener N, 490 g of a 1.5% strength aqueous solution of Prisulon L 150 K (Chem. Fabr. Tübingen) containing 3% of citric acid and 5 g of formic acid.

The print paste has a pH value of 3.0 and a viscosity of 17 d Pas.

Fixation and aftertreatment are carried out as under (a). The result is a print similar to under (a), but with a 42% higher color yield.

EXAMPLE 2

(a) A knitted fabric made of polyethylene glycol terephthalate fibers is printed with a print paste which contains:

5 g of a commercially available, nonionically finished liquid formulation of Disperse Blue 165, C.I. 11,077, and:

300 g of a 2% strength aqueous solution of Samaron thickener N.

The pH value of the print paste is 6.7 and the viscosity is 37 d Pas.

The printed knit is fixed and aftertreated, both steps being carried out as in Example 1. This gives a blue print which has good fastness properties.

(b) The same dyestuff is incorporated in the same concentration in a print paste which contains:

550 g of a 2% strength aqueous solution of Samaron thickener N, 440 g of a 1% strength aqueous solution of Diagum S2 (Diamalt AG) containing 3% of citric acid and:

5 g of citric acid.

The pH value of this print paste is 2.7, and the viscosity is 16 d Pas. The same substrate as under (a) is printed. Fixation and aftertreatment correspond to (a). This gives the same blue print but with a 37% higher color yield.

EXAMPLE 3

(a) A twill made of continuous polyethylene glycol terephthalate filaments is printed with a print paste which contains:

30 g of a commercially available, nonionically finished liquid formulation of Disperse Violet 26, C.I. 62,025, and:

350 g of a 2.5% strength aqueous solution of Acraconc C (Bayer).

The print paste has a pH value of 7.8 and a viscosity of 34 d Pas.

The printed fabric is steamed under 1.5 atmospheres gage for 20 minutes in a pressure steamer, and is then aftertreated as in Example 1. This gives a brilliant reddish violet print having good fastness properties.

(b) The same fabric is printed with a print paste which contains the same dyestuff in the same concentration and 250 g of a 2.5% strength aqueous solution of Acraconc C, 715 g of a 1% strength aqueous solution of Polyprint N 271 (Polygal AG) containing 3% of citric acid and:

5 g of maleic acid.

The pH value of this print paste is 2.5 and the viscosity is 28 d Pas.

Fixation and aftertreatment correspond to those under (a). A print is obtained which is similar but has a 55% higher color yield.

EXAMPLE 4

(a) A polyethylene glycol terephthalate staple fiber fabric is printed with a print paste of the following composition:

30 g of a commercially available, nonionically finished liquid formulation of Disperse Yellow 56 are stirred into:

250 g of a 1% strength aqueous solution of EMA 91 (Monsanto) containing 1% of 25% strength aqueous ammonia solution.

720 g of water are used in making up to 1,000 g.

The pH value of the print paste is 5.0 and the viscosity is 68 d Pas.

The printed fabric is heated at 200° C. for 1 minute on a hot-air tenter frame, and is then subjected to the same aftertreatment as in Example 1. This gives a golden yellow print having good fastness properties.

(b) The same fabric is printed with a print paste which contains the same dyestuff in the same amount and also:

200 g of a 1% strength aqueous solution of EMA 91, 765 g of a 1% strength aqueous solution of Diagum S2 (Diamalt AG) containing 3% of citric acid and:

5 g of citric acid.

The print paste has a pH value of 3.1 and a viscosity of 26 d Pas.

Fixation and aftertreatment correspond to (a). Again a golden yellow print is obtained which has good fastness properties and a 38% higher color yield.

EXAMPLE 5

(a) A fabric made of the flame-retardant polyester fiber® TREVIRA 270 is printed with a print paste which contains:

25 g of a commercially available, nonionically finished liquid formulation of Disperse Red 200 and:

500 g of a 3% strength aqueous solution of Imperon thickener F.

The print paste has a pH value of 7.5 and a viscosity of 40 d Pas.

The printed fabric is fixed at 200° C. for 1 minute, and aftertreated as in Example 1.

This gives a brilliant yellowish red print having good fastness properties.

(b) The same fabric is printed with a print paste which contains the same dyestuff in the same concentration and:

400 g of a 3% strength aqueous solution of Imperon thickener F, 571 g of a 1.5% strength aqueous solution of Prisulon L 150 K (Chem. Fabr. Tübingen) containing 3% of citric acid and:

4 g of maleic anhydride.

The print paste has a pH value of 2.9 and a viscosity of 25 d Pas.

The fabric is fixed and aftertreated, both steps being carried out as under (a). This gives a similar golden yellow print which has a 35% higher color yield.

EXAMPLE 6

(a) A fabric knitted from nylon 472 filaments is printed with a print paste of the following composition:

20 g of a commercially available, nonionically finished liquid formulation of Disperse Red 184 are incorporated in:

350 g of a 1% strength aqueous solution of Carbopol 846 (Goodrich) containing 1% of 25% strength aqueous ammonia solution.

630 g of water are used in making up to 1,000 g.

The pH value of the print paste is 6.4 and the viscosity is 120 d Pas.

The printed knit is dried, steamed at 175° C. for 7 minutes in superheated steam, and then finished as in Example 1.

This gives a bluish red print having good fastness properties.

(b) The same knit is printed with a print paste which contains the same dyestuff in the same concentration and also:

500 g of a 1% strength aqueous solution of Carbopol 846 as under (a), 475 g of a 1.5% strength aqueous solution of Prisulon L 150 K (Chem. Fabrik Tübingen) containing 3% of citric acid and:

5 g of malonic acid.

The print paste has a pH value of 3.0 and a viscosity of 26 d Pas.

The fabric is fixed and aftertreated, both steps being carried out as under (a). This gives the same red print having a 30% higher color yield.

EXAMPLE 7

(a) A twill made of polyethylene glycol terephthalate filaments is nip-padded with the aid of a thousand-point roller with a padding color of the following composition:

30 g of a commercially available, nonionically finished liquid formulation of Disperse Blue 148 are stirred into:

350 g of a 2.5% strength aqueous solution of Lutexal HSF (BASF).

620 g of water are used in making up to 1,000 g.

The padding color has a pH value of 7.3 and a viscosity of 35 d Pas.

The nip-padded fabric is dried, steamed under 1.5 atmospheres gage for 20 minutes, and aftertreated in the same way as the fabric in Example 1.

This gives a dark blue dyeing having good fastness properties.

(b) The same fabric is nip-padded with a padding color which contains the same dyestuff in the same concentration as under (a) and also 250 g of a 2.5% strength aqueous solution of Lutexal HSF, 719 g of a 1% strength solution of Diagum S2 (Diamalt AG) containing 3% of citric acid and:

1 g of chloroacetic acid.

The pH value of the padding color is 3.3 and the viscosity is 15 d Pas.

The fabric is fixed and finished, both steps being carried out as under (a). This gives a deep blue dyeing having a color yield which is 89% higher than under (a).

EXAMPLE 8

(a) A twill made of polyethylene glycol terephthalate filaments is printed with a print paste of the following composition:

30 g of a commercially available, nonionically finished liquid formulation of Disperse Red 92 are stirred into:

250 g of a 1% strength aqueous solution of EMA 91 (Monsanto) containing 1% of 25% strength aqueous ammonia solution.

720 g of water are used in making up to 1,000 g.

The pH value of the print paste is 5.3 and the viscosity is 32 d Pas.

The printed fabric is fixed in hot air of 200° C. for 1 minute, and aftertreated as in Example 1.

This gives a pink print having good fastness properties.

(b) A similar fabric is printed with a print paste which contains the same amount of the same dyestuff and also:

250 g of a 1% strength aqueous solution of EMA 91, 715 g of a 1.5% strength aqueous solution of Prisulon L 150 K (Chem. Fabr. Tübingen) containing 3% of citric acid and:

5 g of citric acid.

The pH value of this print paste is 3.0 and the viscosity is 69 d Pas.

The fabric is further treated as under (a).

This gives a pink print having the same fastness properties and a 67% higher color yield. Even the reverse face of the print is 5% stronger than the print of (a).

EXAMPLE 9

(a) A fabric made of polyethylene glycol terephthalate staple fibers is printed with a print paste of the following composition:

30 g of a commercially available, nonionically finished liquid formulation of Disperse Blue 87 are stirred together with:

250 g of the thickening of Example 8(a), and the mixture is made up with:

720 g of water to give 1,000 g.

The print paste has a pH value of 4.8 and a viscosity of 37 d Pas.

The printed fabric is steamed under 1.5 atmospheres gage for 20 minutes, and aftertreated as in Example 1.

A greenish blue print is obtained which has good fastness properties.

(b) A fabric of the same type is printed with a print paste which contains the same amount of the same dyestuff and:

250 g of the thickening described under (a), 715 g of a 1% strength aqueous solution of Polyprint N 271 (Polygal AG) containing 3% of citric acid and:

5 g of citric acid.

The pH value of the print paste is 2.6 and the viscosity is 40 d Pas.

The fabric is fixed and finished, both steps being carried out as under (a).

A print is obtained which has the same hue as under (a) but a 32% higher color yield.

EXAMPLE 10

(a) A fabric knitted from polyethylene glycol terephthalate filaments is printed with a print paste which contains:

5 g of a commercially available, nonionically finished liquid formulation of Disperse Violet 48 and:

250 g of the synthetic thickening described under Example 9(a).

The pH value of the print paste is 4.3 and the viscosity is 42 d Pas.

The printed knit is steamed under 1.5 atmospheres gage for 20 minutes in saturated steam, and is then finished as in Example 1.

This gives a violet print which has good fastness properties.

(b) An identical knit is printed in the same way with a print paste which contains the same amount of the same dyestuff and:

500 g of the synthetic thickening described under (a), 490 g of the natural thickening described under 9(b) and:

5 g of chloroacetic acid.

The pH value is 2.6 and the viscosity is 22 d Pas.

Fixation and aftertreatment as under (a) likewise give a violet print having a 20% higher color yield.

EXAMPLE 11

(a) A georgette fabric made of triacetate filaments is printed with a print paste of the following composition:

30 g of a commercially available, nonionically finished liquid formulation of Disperse Violet 40 are mixed with:

350 g of a 1% strength aqueous solution of the sodium salt of a copolymer of 60% of acrylamide and 40% acrylic acid which has a molecular weight of 1,500,000.

620 g of water are used in making up to 1,000 g.

The pH value of the print paste is 5.9 and the viscosity is 32 d Pas.

The printed fabric is steamed under 1.5 atmospheres gage for 20 minutes, and aftertreated as in Example 1.

A bluish red print is obtained which has good fastness properties.

(b) The same fabric is printed with a print paste which contains the same dyestuff in the same amount and:

300 g of the synthetic thickening described under (a), 665 g of the natural thickening described under 9(b) and:

5 g of phosphoric acid.

The pH value of the print paste is 1.8 and the viscosity is 26 d Pas.

Fixation and aftertreatment are carried out as under (a).

A bluish red print is obtained which has a 56% higher color yield.

EXAMPLE 12

(a) A twill made of polyethylene glycol terephthalate filaments is printed with a print paste of the following composition:

30 g of a commercially available, nonionically finished liquid formulation of Disperse Red 60, C.I. 60,756, are incorporated into 250 g of the synthetic thickening described in Example 9.

720 g of water are used in making up to 1,000 g.

The print paste has a pH value of 6.6 and a viscosity of 41 d Pas.

The fabric is steamed under 1.5 atmospheres gage for 20 minutes in a pressure steamer, and then after-treated as in Example 1.

A pink print results which has satisfactory fastness properties.

(b) The same fabric is printed with a print paste which contains the same dyestuff in the same concentration and 200 g of the synthetic thickening described under (a), 765 g of the natural thickening described in Example 8(b) and:

5 g of citric acid.

The pH value of the print paste is 3.0 and the viscosity is 48 d Pas.

The print is treated in the same way as under (a) and a pink print results which has a 47% higher color yield.

EXAMPLE 13

(a) A twill made of continuous polyethylene glycol terephthalate filaments is printed with a print paste of the following composition:

5 g of the disperse dyestuff of Example 10 are stirred into:

300 g of a 2% strength aqueous solution of Samaron thickener N.

695 g of water are used in making up to 1,000 g.

The pH value of the print paste is 6.7 and the viscosity is 17 dPas.

The printed and dried fabric is fixed and aftertreated, both steps being carried out as in Example 1. This gives a violet print having good fastness properties.

(b) The same fabric is printed with a print paste which contains the same dyestuff in the same amount and also:

700 g of Samaron thickener N solution (2%), 200 g of a 10% strength aqueous solution of Monagum W (Diamalt) and:

5 g of maleic acid.

The print paste has a pH value of 3.9 and a viscosity of 22 dPas.

Fixation and aftertreatment correspond to (a). The print obtained is also violet and has good fastness properties but it also has a 157% higher color yield.

EXAMPLE 14

(a) A polyethylene glycol terephthalate staple fiber fabric is printed with a print paste which contains:

15 g of a commercially available, nonionically finished liquid formulation of Disperse Orange 71 and:

400 g of a 2% strength aqueous solution of Samaron thickener N.

The pH value of the print paste is 6.5 and the viscosity is 40 dPas.

The printed fabric is fixed and aftertreated, both steps being carried out as in Example 1. This gives an orange print having good fastness properties.

(b) The same dyestuff is incorporated in the same concentration into a print paste which contains:

500 g of a 2% strength aqueous solution of Samaron thickener N, 450 g of a 3% strength aqueous solution of Tylose C 600 and:

5 g of malonic acid.

The pH value of this print paste is 3.5 and the viscosity is 15 dPas.

The print paste is printed onto the same substrate as under (a), and fixed and aftertreated, both steps being carried out as under (a). An identical orange print results which has a 29% higher color yield.

EXAMPLE 15

(a) A fabric as in Example 1 is printed with a print paste of the following composition:

30 g of a commercially available, nonionically finished liquid formulation of Disperse Blue 130 are stirred into:

300 g of a 1% strength aqueous solution of EMA 91 (Monsanto) containing 1% of 25% strength aqueous ammonia solution.

670 g of water are used in making up to 1,000 g.

The print paste has a pH value of 8.2 and a viscosity of 18 dPas.

The printed and dried fabric is fixed and aftertreated, both steps being carried out as in Example 3. This gives a navy shade having good fastness properties.

(b) The same fabric is printed with a print paste which contains the same dyestuff in the same concentration and:

400 g of the EMA 91 solution described under (a) and also:

350 g of a 4% strength aqueous solution of Tylose MH 300 and:

15 g of citric acid.

The print paste has a pH value of 3.1 and a viscosity of 20 dPas.

The fabric is fixed and aftertreated, both steps being carried out as under (a). This gives the same navy shade in a 27% higher color yield.

EXAMPLE 16

(a) A fabric as in Example 1 is printed with a print paste which contains:

20 g of a commercially available, nonionically finished liquid formulation of Disperse Orange 31 and:

350 g of a 2.5% strength aqueous solution of Lutexal HSF (BASF).

The print paste has a pH value of 8.2 and a viscosity of 65 dPas.

The printed fabric is fixed and aftertreated, both steps being carried out as in Example 4. This gives an orange print having good fastness properties.

(b) The same fabric is printed with a print paste which contains the same dyestuff in the same concentration and:

600 g of a 2.5% strength aqueous solution of Lutexal HSF, and also:

350 g of a 4% strength aqueous solution of Tylose H 4000 and:

8 g of formic acid.

The pH value of this print paste is 3.6 and the viscosity is 27 dPas.

Fixation and aftertreatment are carried out as under (a). The same orange print is obtained with a 136% higher color yield.

I claim:

1. In a process for pad-dyeing or printing a sheet-like textile of synthetic fiber material with a disperse dyestuff dispersed in an aqueous medium in association with an anionic or nonionic dispersant, the padding liquor or print paste containing in addition to the aqueous dyestuff dispersion a thickening agent comprising a water-soluble synthetic polymerization product containing one or more carboxylic acid groups, the improvement which comprises:

incorporating in the padding liquor or print paste a natural thickening agent derived from a polysaccharide of non-ionic or anionic type, the viscosity of a 1% strength aqueous solution of which is from 0.05 to 20 Pas, and setting the pH of the padding liquor or print paste containing the thickening agents at a value of 1.2 to 4.5, whereby the electrolyte sensitivity of the synthetic thickening agent in an acidic medium is substantially decreased.

2. A process as claimed in claim 1, wherein each said polymerization product is a polymer or copolymer of a mono-ethylenically or polyethylenically unsaturated low molecular weight hydrocarbon compound which contains units of an unsaturated monocarboxylic or dicarboxylic acid.

3. A process as claimed in claim 2, wherein each said polymer or copolymer is crosslinked with a polyhydric alcohol, amine or amino alcohol.

4. A process as claimed in claim 2, wherein each said polymer or copolymer contains a methylolated amide group.

5. A process as claimed in claim 1, wherein each said polysaccharide derivative is a nonionic or anionic type high molecular weight derivative of carob bean flour or guar flour in degraded or etherified form, or a nonionic or anionic type starch ether or cellulose ether.

6. A process as claimed in claim 1, wherein the pH value of the padding liquor or print paste is set with the aid of a weak to medium strength inorganic or organic, monobasic or polybasic acid or a corresponding acidic salt.

7. A process as claimed in claim 1, wherein the synthetic fiber material comprises polyester, triacetate or Nylon type 472 fibers or filaments.

8. A process as claimed in claim 1, wherein each said disperse dyestuff is fixed on the textile material by means of hot air, superheated steam or saturated steam.

9. An auxiliary for carrying out the process as claimed in claim 1, which comprises a thickener combination of a water-soluble synthetic polymerization product containing one or more carboxylic acid groups and a thickening agent derived from a polysaccharide of nonionic or anionic type, the viscosity of a 1% strength aqueous solution of which is from 0.05 to 20 Pas.

* * * * *